US007942568B1

(12) United States Patent
Branch et al.

(10) Patent No.: US 7,942,568 B1
(45) Date of Patent: May 17, 2011

(54) ACTIVE MICROMIXER USING SURFACE ACOUSTIC WAVE STREAMING

(75) Inventors: Darren W. Branch, Albuquerque, NM (US); Grant D. Meyer, Ithaca, NY (US); Harold G. Craighead, Ithaca, NY (US)

(73) Assignee: Sandia Corporation, Albuquerque, NM (US)

( * ) Notice: Subject to any disclaimer, the term of this patent is extended or adjusted under 35 U.S.C. 154(b) by 1082 days.

(21) Appl. No.: 11/155,108

(22) Filed: Jun. 17, 2005

(51) Int. Cl.
*B01F 11/02* (2006.01)

(52) U.S. Cl. ..... 366/127; 366/DIG. 4

(58) Field of Classification Search ..... 366/127, 366/DIG. 4
See application file for complete search history.

(56) References Cited

U.S. PATENT DOCUMENTS

| | | | | |
|---|---|---|---|---|
| 2,578,505 | A * | 12/1951 | Carlin | 366/114 |
| 3,222,221 | A * | 12/1965 | Branson | 134/1 |
| 4,433,916 | A * | 2/1984 | Hall | 366/114 |
| 4,675,839 | A * | 6/1987 | Kerr | 708/815 |
| 5,006,749 | A * | 4/1991 | White | 310/323.03 |
| 5,069,664 | A * | 12/1991 | Guess et al. | 604/22 |
| 5,179,394 | A * | 1/1993 | Hoshino et al. | 347/46 |
| 5,287,036 | A * | 2/1994 | Penunuri | 310/313 R |
| 5,400,788 | A * | 3/1995 | Dias et al. | 600/459 |
| 5,646,039 | A * | 7/1997 | Northrup et al. | 435/287.2 |
| 6,010,316 | A * | 1/2000 | Haller et al. | 417/322 |
| 6,244,738 | B1 * | 6/2001 | Yasuda et al. | 366/114 |
| 6,649,069 | B2 * | 11/2003 | DeAngelis | 210/748 |
| 6,682,214 | B1 * | 1/2004 | Vivek et al. | 366/108 |
| 6,749,406 | B2 * | 6/2004 | Keilman | 417/322 |
| 6,777,245 | B2 * | 8/2004 | Wixforth | 436/180 |
| 6,910,797 | B2 | 6/2005 | Falcon | 366/127 |
| 7,354,556 | B2 | 4/2008 | Perkins | 422/128 |
| 7,731,412 | B2 * | 6/2010 | Sparey-Taylor et al. | 366/127 |
| 2004/0101975 | A1 * | 5/2004 | Gauer | 436/518 |
| 2004/0115097 | A1 | 6/2004 | Wixforth et al. | 422/100 |
| 2004/0257906 | A1 * | 12/2004 | Scriba et al. | 366/127 |
| 2007/0146439 | A1 * | 6/2007 | Chou et al. | 347/68 |

(Continued)

FOREIGN PATENT DOCUMENTS

| | | |
|---|---|---|
| WO | WO 02/081070 | 10/2002 |

(Continued)

OTHER PUBLICATIONS

Y Ito, K Uchino. Piezoelectricity. In Wiley Encyclopedia of Electrical and Electronics Engineering, John Wiley and Sons Inc 1999, pp. 479-490.*

(Continued)

*Primary Examiner* — David L Sorkin
*Assistant Examiner* — Andrew Janca
(74) *Attorney, Agent, or Firm* — Kevin W. Bieg

(57) ABSTRACT

An active micromixer uses a surface acoustic wave, preferably a Rayleigh wave, propagating on a piezoelectric substrate to induce acoustic streaming in a fluid in a microfluidic channel. The surface acoustic wave can be generated by applying an RF excitation signal to at least one interdigital transducer on the piezoelectric substrate. The active micromixer can rapidly mix quiescent fluids or laminar streams in low Reynolds number flows. The active micromixer has no moving parts (other than the SAW transducer) and is, therefore, more reliable, less damaging to sensitive fluids, and less susceptible to fouling and channel clogging than other types of active and passive micromixers. The active micromixer is adaptable to a wide range of geometries, can be easily fabricated, and can be integrated in a microfluidic system, reducing dead volume. Finally, the active micromixer has on-demand on/off mixing capability and can be operated at low power.

18 Claims, 12 Drawing Sheets

U.S. PATENT DOCUMENTS

2009/0314062 A1* 12/2009 Tsuyoshi et al. ..... 73/53.01

FOREIGN PATENT DOCUMENTS

WO WO 03/018181 A1 * 3/2005

OTHER PUBLICATIONS

D Morgan. Surface acoustic wave devices. In Wiley Encyclopedia of Electrical and Electronics Engineering, John Wiley and Sons Inc 1999, pp. 1-19.*

Ito et al. Piezoelectricity. In Wiley Encyclopedia of Electrical and Electronics Engineering, John Wiley and Sons Inc 1999, pp. 489-490.

EPO machine translation of WO 2002/0810710 A1, downloaded Feb. 19, 2009.

Nam-Trung Nguyen, "Micromixers—a review," Journal of Micromechanics and Microengineering, 15 (2005) R1-R16.

Martin Bengtsson, "Ultrasonic agitation in microchannels," Anal Bioanal. Chem. (2004) 378, 1716-1721.

Julio M. Ottino, "Introduction: mixing in microfluidics," Phil. Trans. R. Soc. Lond. A (2004) 362, 923-935.

Christopher J. Campbell, "Microfluidic mixrs: from microfabricated to self-assembling devices," Phil. Trans. R. Soc. Lond. A (2004) 362, 1069-1086.

Jens Branebjerg, "Fast Mixing by lamination," Proceedings of IEEE Micro Electro Mechanical Systems (MEMS); 1996; 441-446.

Norbert Schwesinger, "A modular microfluid system with an integrated micromixer," J. Micromech. Microeng. 6 (1996) 99-102.

Robin H. Liu, "Passive Mising in a Three-Dimensional Serpentine Microchannel," J. Micromech. Microeng. Sys., vol. 9, No. 2, Jun. 2000.

Ravi A. Vijayendran, "Evaluation of a Three-Dimensional Micromixer ina Surface-Based Biosensor," Langmuir 2003, 19, 1924-1828.

Abraham D. Stroock, "Chaotic Mixer for Microchannels," Science vol. 295, Jan. 25, 2002, 647-651.

Xu Zhu, "Microfluidic motion generation with acoustic waves," Sensors and Actuators A 66 (1998) 355-360.

Zhen Yang, "Ultrasonic micromixer for microfluidic systems," Sensors and Actuators A 93 (2001) 266-272.

Goksen G. Yaralioglu, "Ultrasonic Mixing in Microfluidic Channels Using Integrated Transducers," Anal. Chem. 2004, 76, 3694-3698.

Toyokazu Uchida, "Investigation of Acoustic Streaming Excited by Surface Acoustic Waves," 1995 IEEE Ultrasonics Symposium—1081-1084.

Koji Miyamoto, "Nonlinear Vibration of Liquid Droplet by Surface Acoustic Wave Excitation," Jpn. J. Appl. Phys. vol. 41 (2002) 3465-3468.

Showko Shiokawa, "The Dynamics of SAW Streaming and its Application to Fluid Devices," Mat. Res. Soc. Symp. Proc. vol. 360, 53-64.

M. G. Cohen, "Optical Study of Ultrasonic Diffraction and Focusing in Anisotropic Media," J. of Appl. Phy., vol. 38, No. 10, Sep. 1967, 3821-3828.

Song Ru Fang, "SAW Focusing by Circular-Arc Interdigital Transducers on YZ-$LiNbO_3$," IEEE Transactions on Ultrasonics, Ferroelectrics, and Frequency Control, vol. 36, No. 2, Mar. 1989 178-184.

* cited by examiner

ACTIVE MICROMIXER USING SURFACE ACOUSTIC WAVE STREAMING

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to fluid mixing in microfluidic devices and, in particular, to a micromixer that actively mixes fluids using surface acoustic wave induced acoustic streaming.

BACKGROUND OF THE INVENTION

Microfluidic devices control and manipulate fluid flows with length scales less than about one millimeter and fluid volumes of less than about a microliter. Microfluidic systems are now in widespread use for a host of applications including biochemical analysis, drug screening, biosensors, chemical reactions, cell sorting, sequencing of nucleic acids, and transport of small volumes of materials. Many of these applications require efficient mixing of biological materials and chemical reagents for the necessary reactions to occur. For these applications, rapid homogenization of two fluid streams in a minimal amount of space is generally highly desirable.

When the dimensions are several hundred micrometers or less, pressure flows are laminar and uniaxial. The Reynolds number (i.e., the ratio of inertial to viscous forces) is small, on the order of unity, and mixing is purely diffusive. For this reason, a molecular diffusion-based mixing process can take tens of seconds up to several minutes. Moreover, the mixing time in solutions containing complex biomolecules, or other large particles, can increase to hours as compared to simple proteins. Even at the scale of microchannels, diffusion-based mixing is slow compared to convection of material along the channel, as described by the Peclet number (i.e., the ratio of convective to diffusive transport, typically greater than one hundred). For example, in water flowing at a velocity of about 1 cm/sec in a 100-μm-wide channel, mixing lengths can be up to tens of centimeters. These mixing times and lengths are far too long for practical, portable microfluidic systems, especially when large particles are to be mixed.

To improve mixing efficacy and homogenization of fluid streams in a microchannel, rapid folding and stretching of the fluid is essential to reduce the mixing time. Rapid stretching and folding of the fluid can be accomplished by using passive or active mixing methods. Passive micromixers rely on forcing liquids through static geometries to fold and stretch the fluid, thereby increasing the interfacial area between adjacent fluid streams. Multiple stage laminations and flow splitting have been used to increase dramatically the interfacial area. See J. Branebjerg et al., "Fast mixing by lamination," *Proc. IEEE MEMS Workshop*, San Diego, Calif. (1996); and N. Schwesinger et al., "A modular microfluid system with an integrated micromixer," *J. Micromech. Microeng.* 6, 99 (1996). Recently, chaotic advection using complicated three-dimensional serpentine twisted channels has been used to achieve seemingly random and chaotic particle trajectories within fluid channels. See R. H. Liu et al., "Passive mixing in a three-dimensional serpentine microchannel," *J. Microelectromech. Sys.* 9, 190 (2000); D. J. Beebe et al., "Passive mixing in microchannels: Fabrication and flow experiments," *Mec. Ind.* 2, 343 (2001); and R. A. Vijayendran et al., "Evaluation of a three-dimensional micromixer in a surface-based biosensor," *Langmuir* 19, 1824 (2003). However, to date such passive micromixers lack efficiency at low Reynolds number. More recently, a passive micromixer using bas-relief features has been demonstrated to provide efficacious mixing, even at low Reynolds number. See A. D. Stroock et al., "Chaotic mixer for microchannels," *Science* 295, 647 (2002). The bas-relief structure was used to generate transverse flows in the microchannel such that liquid streams twisted over one another. However, a significant disadvantage is that, in order to generate the chaotic-advection required for mixing, complex three-dimensional microstructures must be fabricated. Further, these meandering paths and complex flow structures can generate dead volume. Such dead volumes can cause sample loss, decreased throughput, increased detection time, and can easily foul when using complex solutions. Moreover, passive mixing methods require fluid flow for mixing to occur.

Active micromixers rely on internal mixing forces within a fluid-carrying channel, typically using moving parts. Active micromixers can be driven, for example, by pressure, temperature, electrohydrodynamic, dielectrophoretic, electrokinetic, magnetohydrodynamic, or ultrasonic actuators. Active micromixers can have greater mixing efficacy than passive micromixers, especially for flows at low Reynolds number. Further, the mixing can be switched on and off, as desired, and can be done in the absence of fluid flow. This assures that the chemical reaction time is faster than the residence time in the microchannel. However, active micromixers require an external power source, and the integration of active mixers in microfluidic systems can also be challenging, requiring complicated actuation structures and costly and complex fabrication processes.

It is well known that ultrasonic actuation can significantly influence the pressure variation within fluids. Acoustic pressure variation can be large enough to cause cavitation, where the pressure forces exceed the intermolecular cohesion forces. Though bubble formation and collapse can induce mixing, a secondary mechanism exists when the acoustic energy is dissipated by viscous stress. The nonlinear hydrodynamic coupling of high amplitude sound waves with the dissipative fluid medium creates an acoustic pressure gradient within the fluid. This large nonlinear gradient results in a steady fluid flow, in a process known as "quartz wind" or acoustic streaming.

Active micromixers based on acoustic streaming have produced liquid oscillations using thickness-mode resonances in zinc oxide (ZnO), induced ultrasonic vibration of thin silicon membranes to actively mix fluids using lead-zirconate-titanate (PZT), and moved liquid droplets using 128° Y-cut X-propagating lithium niobate (128° YX $LiNbO_3$). Typically, these micromixers use transducer disks attached to the exterior of a fluidic channel to convert radio-frequency electrical energy into an ultrasonic acoustic wave normal to the disk. See X. Zhu and E. S. Kim, "Microfluidic motion generation with acoustic waves," *Sensors and Actuators A* 66, 355 (1998); Z. Yang et al., "Ultrasonic micromixer for microfluidic systems," *Sensors and Actuators A* 93, 266 (2001); and G. G. Yaralioglu et al., "Ultrasonic Mixing in Microfluidic Channels Using Integrated Transducers," *Anal. Chem.* 76, 3694 (2004).

Acoustic streaming can also be generated by a surface acoustic wave (SAW) device. A Rayleigh wave can readily radiate longitudinal waves into a fluid when the SAW propagation surface is in contact with the fluid. The SAW streaming force resulting from a leaky Rayleigh wave can be much greater than other types of acoustic streaming forces, such as attenuated plane waves traveling in a bulk liquid. However, early studies, that used 128° YX $LiNbO_3$ to perturb fluids, only considered acoustic wave streaming in open systems and did not use the streaming force for fluid mixing in closed channels. See T. Uchida et al., "Investigation of Acoustic Streaming Excited by Surface Acoustic Waves," *Proc.* 1995 *IEEE Ultrasonics Symposium,* 1081 (1995); K. Miyamoto et al., "Nonlinear vibration of liquid droplets by surface acoustic wave excitation," *Jpn. J. Appl. Phys.* 41, 3465 (2002); and S. Shiokawa and Y. Matsui, "The Dynamics of SAW Streaming and its Application to Fluid Devices," *Mat. Res. Soc. Symp. Proc.* 360, 53 (1995), all of which are incorporated herein by reference.

Therefore, a need still exists for an efficient, active micromixer based on SAW streaming that can be integrated in a closed microfluidic system.

SUMMARY OF THE INVENTION

The present invention is directed to an active micromixer, comprising a piezoelectric substrate having a surface; at least one interdigital transducer on the surface of the substrate; a microfluidic channel, containing a fluid, acoustically coupled to the surface of the substrate; and an RF signal generator for exciting the at least one interdigital transducer and generating a SAW that propagates on the surface of the substrate to the channel and couples energy into the fluid in an active mixing region of the channel.

The piezoelectric substrate can a crystal plate, such as 128° YX $LiNbO_3$, 36° YX $LiTaO_3$, crystalline quartz, zinc oxide, or aluminum nitride. The at least one interdigital transducer can comprise two opposing interdigital transducers to contra-propagate acoustic waves along the free surface of the substrate to the fluid interface. The interdigital transducer can be unfocused or focused, using structures such as waveguides and acoustic horns to concentrate the acoustic field at the active mixing region of the channel.

The energy coupling of the SAW induces acoustic streaming in the fluid, thereby actively mixing the fluid streams. The SAW is preferably a Rayleigh wave that couples strongly to the fluid. Active mixing using acoustic streaming has a number of advantages over other types of active micromixers. The steaming-based active micromixer has improved efficiency and improved reliability, since it has no moving parts. Further, the lack of a mechanical actuator may be less damaging to biological molecules in the fluids. The lack of mechanical contact with the fluid prevents the micromixer from being susceptible to biofouling and channel clogging, and can be used to remove non-specifically bound materials from surfaces. The surface acoustic wave transducer can couple to the fluid directly, or remotely, through the walls of the channel. Further, the active micromixer is adaptable to a wide range of geometries, can be easily fabricated, and can be integrated in a microfluidic system, reducing dead volume. Further, the active micromixer has on-demand on/off mixing capability and can be operated at low power. The SAW-based active micromixer is particularly useful in fluidic applications in which the Reynolds number is small.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

FIG. 6A shows the established laminar flow condition in the PDMS microchannel (Re=2.0) in the absence of mixing. The light-shaded bottom half of image contains the protein-A labeled fluorescent Alexa-488 dye. FIG. 6B shows that rapid mixing was observed when acoustic excitation was applied to the active micromixer. FIG. 6C that laminar flow was restored within a residence time period after removal of acoustic excitation.

FIGS. 9A, 9C, and 9E were captured at 170 μm above the substrate surface. FIGS. 9B, 9D, and 9F were captured at 340 μm above the substrate surface. FIGS. 9A and 9B had a total excitation power of 4.5 dBm (2.8 mW). FIGS. 9C and 9D had a total excitation power of −3.5 dBm (0.47 mW). FIGS. 9E and 9F had a total excitation power of −15.5 dBm (28 μW).

DETAILED DESCRIPTION OF THE INVENTION

Figure 1:
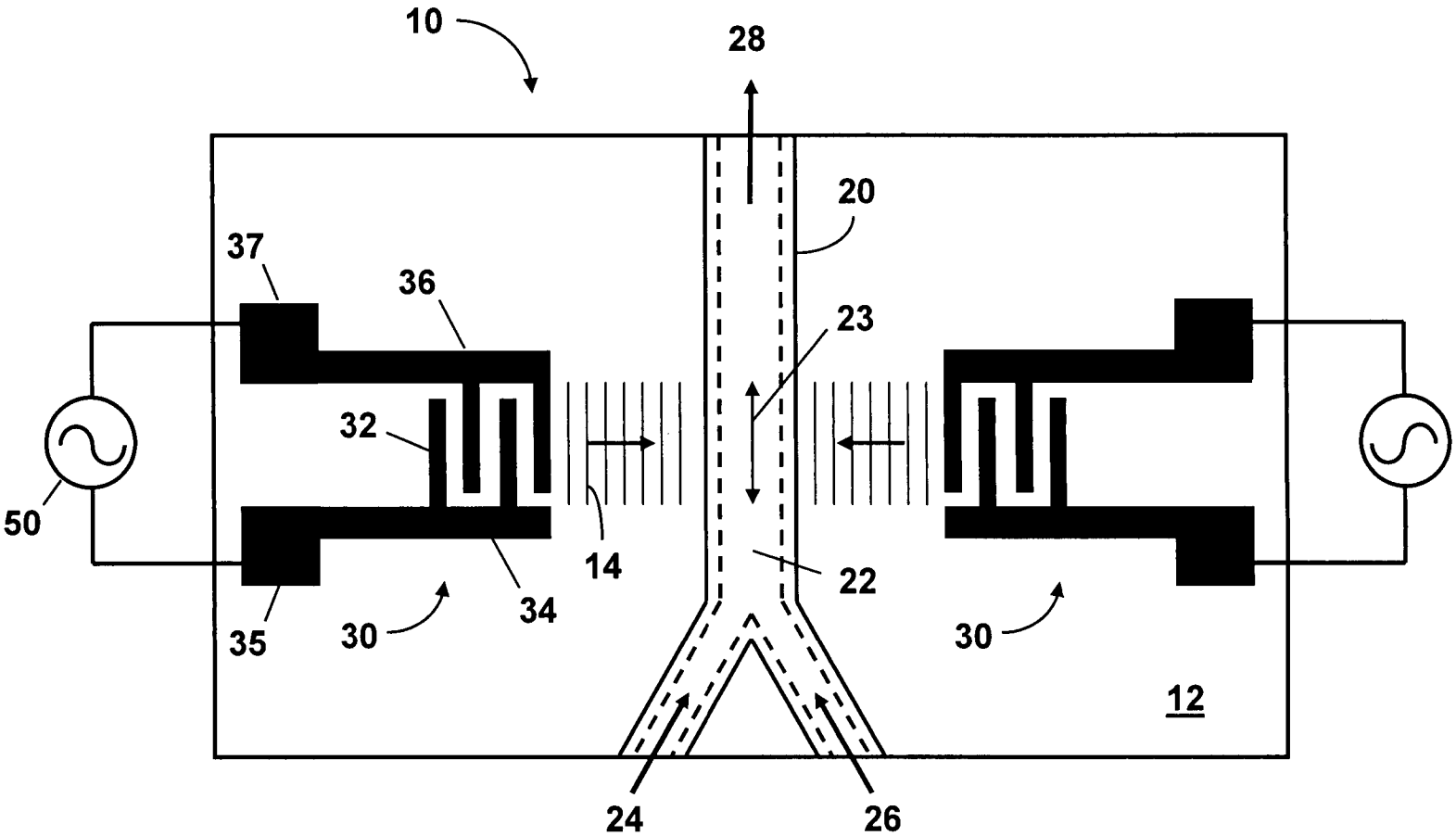
FIG. 1 shows a schematic top view of an exemplary active micromixer that uses SAW streaming to actively mix fluid streams in a microfluidic channel. The exemplary active micromixer comprises two opposing interdigital transducers that contra-propagate SAWs inwardly to a central microfluidic channel.

The active micromixer of the present invention comprises a SAW transducer integrated with a microfluidic channel to enable mixing of fluid in the channel by SAW streaming. In FIG. 1 is shown a schematic top view of an exemplary SAW-based active micromixer 10 of the present invention. The active micromixer 10 is built on a piezoelectric substrate 12. When a radio frequency (RF) voltage is applied to the SAW transducer 30, a SAW 14 is generated on the surface of the substrate 12. Therefore, electric energy of an RF voltage source 50 is transduced into the mechanical energy of the SAW 14. The SAW 14 propagates on the free surface of the substrate 12 to the microfluidic channel 20 where the mechanical energy of the acoustic wave is dissipated in a fluid 22 contained in the channel 20. The lateral width, or acoustic aperture, of the propagating SAW 14 defines an active mixing region 23 within the channel 20. The fluid 22 can be quiescent or flowing. For example, fluid 22 flowing from two or more input fluid streams 24 and 26 can enter the microfluidic channel 20 (e.g., a Y-junction channel) upstream from the active mixing region 23. When flow in the microfluidic channel 20 is laminar, mixing across the joined adjacent fluid streams 24 and 26 upstream from the active mixing region 23 is diffusive and very slow. However, when the adjacent streams 24 and 26 enter the active mixing region 23, they are mixed by rapid folding and stretching of the fluid by SAW streaming, resulting in a mixed fluid stream 28 downstream from the active mixing region 23.

The substrate 12 can be a precisely oriented piezoelectric crystal plate that can generate a SAW having an out-of-plane component. The SAW is preferably a Rayleigh wave that has a strong normal displacement. However, other types of surface waves with weaker out-of-plane components, such as impure shear waves, can also be generated. For example, the crystal plate can comprise ST-quartz, zinc oxide (ZnO), aluminum nitride (AlN), lithium niobate ($LiNbO_3$), or lithium tantalate ($LiTaO_3$). The electromagnetic coupling coefficient ($K^2$) is a measure of the efficiency of the piezoelectric material in converting an applied electrical signal into mechanical energy of the SAW. Preferably, the substrate 12 comprises a strong piezoelectric material, such as 128° YX $LiNbO_3$, which has a large electromechanical coupling coefficient. The electromechanical coupling coefficient for 128° YX $LiNbO_3$ ($K^2$=5.5%) is much larger than quartz, ZnO, or AlN (i.e., $K^2$=0.16, 1.1, and 0.4%, respectively), which also generate Rayleigh waves. The substrate 12 can comprise a piezoelectric optical material. For example, a $LiNbO_3$ substrate enables the combination of fluidic handling, surface cleaning, and optical detection using total internal reflection fluorescence.

Alternatively, since the SAW 14 propagates along the surface, the substrate 12 can comprise a thin piezoelectric crystal layer that is thicker than the SAW penetration depth (i.e., greater than a few acoustic wavelength thickness) on a rigid, nonpiezoelectric substrate. For example, the substrate 12 can comprise a thin film of AlN, ZnO, or $LiNbO_3$ on a glass or semiconductor substrate. These materials can be deposited by sputtering or sol-gel methods. Alternatively, the surface of the substrate can comprise a piezoelectric portion and a nonpiezoelectric, but elastic, portion. The SAW can be generated on the piezoelectric portion of the surface and can propagate on the nonpiezoelectric portion of the surface to the channel.

The SAW 14 can be generated by a transducer comprising at least one interdigital transducer (IDT) 30 on the surface of the piezoelectric substrate 12. An IDT 30 comprises a finger-like periodic pattern of parallel in-plane electrodes 34 and 36. Adjacent fingers 32 from the opposing electrodes 34 and 36 form finger pairs. The spatial periodicity, or spatial wavelength, of the IDT 30 is the distance between the centerlines of adjacent finger pairs. When a RF drive voltage 50 is applied to contact pads 35 and 37, a spatially periodic, surface-concentrated electric field distribution is established between the spatially periodic electrode fingers 32 that penetrates into the piezoelectric substrate 12. Because of the piezoelectric coupling, an elastic strain distribution with periodicity is created in the substrate 12, thereby generating the SAW 14. To generate the correct surface wave, the proper axis of the piezoelectric crystal 12 is preferably aligned with the IDT 30. The strength of the outputted SAW can be controlled by changing the overlap of the electrodes, number of finger pairs, their periodicity, the finger pattern, and the power input. Other IDT geometries can be used to minimize phase distortion, insertion loss, control bandwidth, etc. For example, the finger pattern can comprise a "split-finger" geometry, wherein each finger is split into two finger electrodes (i.e., with four fingers per period, rather than two as with the single-finger electrode geometry). This split-finger geometry has been shown to minimize interelectrode reflections of the acoustic wave within the IDT structure. See D. Royer and E. Dieulesaint, *Elastic Waves in Solids I and II*, Springer (2000); and C. K. Campbell, *Surface Acoustic Wave Devices for Mobile and Wireless Communications*, Academic Press (1998).

The SAW transducer is most efficient when the excitation frequency of the RF source is such that the physical spacing between alternate finger pairs of the IDT corresponds to the wavelength of the SAW (i.e., at the synchronous frequency). Typically, a SAW transducer can operate at a frequency that is about 10 to 100 times higher than a bulk acoustic wave resonator. Therefore, the SAW frequency can be approximately 20 MHz to 1 GHz or higher. The acoustic wavelength of the SAW is inversely related to the frequency by the velocity in the piezoelectric material. The SAW velocity depends on the elasticity, density, and piezoelectric properties for a particular crystal cut and orientation. SAW velocities are typically about five orders of magnitude smaller than those of electromagnetic waves. Therefore, acoustic wavelengths are typically 2-100 μm.

Preferably, the active micromixer 10 comprises two opposing IDTs 30 to provide a dual excitation (as shown). Together, the transducers generate two contra-propagating SAWs 14 that irradiate the central microfluidic channel 20 from opposite sides. However, since each IDT 30 typically generates bidirectional SAWs that propagate symmetrically in opposite directions, acoustic reflectors (not shown) can be fabricated at each end of the substrate 12 to reflect the outwardly propagating surface waves and thereby reinforce the inwardly propagating SAWs 14. Various grating structures are known to provide efficient acoustic reflectors. These reflection grating structures include shallow grooves etched into the surface or open-circuited or short-circuited thin-film metal strips deposited on the substrate surface. Asymmetries can also be created within the IDT structure itself to make the transducer more unidirectional. Alternatively, acoustically lossy terminations (not shown) can be fabricated at each end of the substrate 12 to absorb the outwardly propagating surface waves.

The overlap of the finger electrodes defines an acoustic aperture, or effective width of the SAW beam 14 exiting the IDT 30. For large acoustic apertures (i.e., widths much greater than the acoustic wavelength), beam spreading due to diffractive effects can be ignored and the length of the active mixing region 23 will be approximately equal to the acoustic aperture of the exiting beam.

Alternatively, the IDT 30 can be a focusing IDT to compress the SAW beamwidth and concentrate the acoustic field at the active mixing region 23 or for coupling into an acoustic waveguide. Increasing the acoustic power density can be especially beneficial for rapid mixing in localized regions. The focusing IDT can use curved metal fingers to generate a converging SAW having a certain aperture angle. Preferably, the finger shape follows lines of constant SAW group velocity, which can be calculated taking into account the anisotropy of the piezoelectric crystal. See M. G. Cohen, "Optical Study of Ultrasonic Diffraction and Focusing in Anisotropic Media," *J. Appl. Phys.* 38(10), 3821 (1967); and S. R. Fang et al., "SAW Focusing by Circular-Arc Interdigital Transducers on YZ—$LiNbO_3$," *IEEE Trans. Ultrasonics, Ferroelectrics, and Freq. Control* 36(2), 178 (1989), which are incorporated herein by reference.

A waveguide can also be used to focus or bend the SAW beam, control beam spreading, or define the acoustic aperture of the beam. An acoustic waveguide is a geometric structure that confines the lateral extent of the acoustic wave and binds the wave to the guide. An acoustic wave can be bound by a waveguide having a central waveguiding region that is slower than an outer cladding region. Because the acoustic wave travels slower in the central region, it is pulled in laterally to the central region, similar to a refractive-index-guided optical wave. Such waveguides may be especially useful for integrated microfluidic devices to enable efficient use of the substrate area and increase functionality and performance of the device.

SAW waveguides are primarily of two types. Overlay waveguides can comprise a strip of slower material (e.g., a metallic film) that is deposited on top of the central waveguiding region of the piezoelectric substrate. Another type of overlay waveguide is the slot waveguide, wherein the substrate is coated with a faster material except for an open slot over the central region. Alternatively, the waveguide can be a topographic waveguide comprising a raised rectangular ridge or wedge that provides a central guiding region (alternatively, the ridge can be defined by lateral grooves formed in the substrate). Such ridge waveguides can provide strong confinement of a SAW beam, permitting relatively sharp bends or strong focusing of the SAW without excessive radiation leakage. The strength of the confinement is a function of the acoustic frequency and can be controlled by the aspect ratio and geometry of the ridge.

Figure 2:
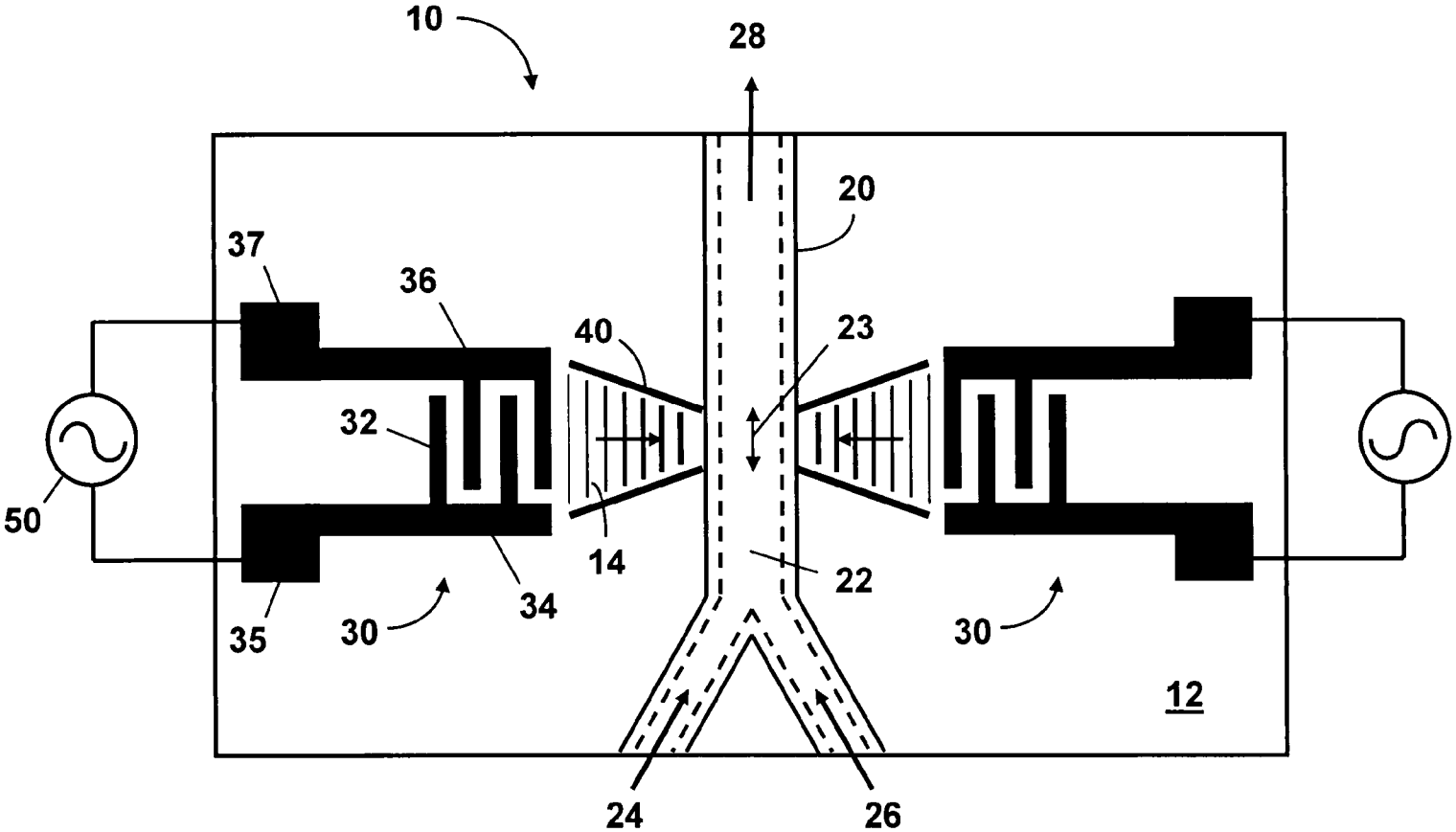
FIG. 2 shows a schematic top view of an exemplary active micromixer that comprises acoustic horns to compress the SAWs to provide a concentrated acoustic field at the active mixing region of the channel.

The waveguide can be tapered to provide an acoustic horn that compresses the beam width of the propagating SAW. In FIG. 2 is shown a schematic top view of the exemplary SAW-based active micromixer 10 that further comprises an acoustic horn 40. The acoustic horn 40 compresses the Rayleigh SAW 14 to provide a concentrated acoustic field at the active mixing region 23 of the channel 20. By using the acoustic horn 40, the acoustic power density can be greatly increased by lateral field confinement. As with the focusing IDT, such acoustic wave amplification may be especially beneficial for improving the efficacy of active mixing using SAW streaming.

Figure 3:
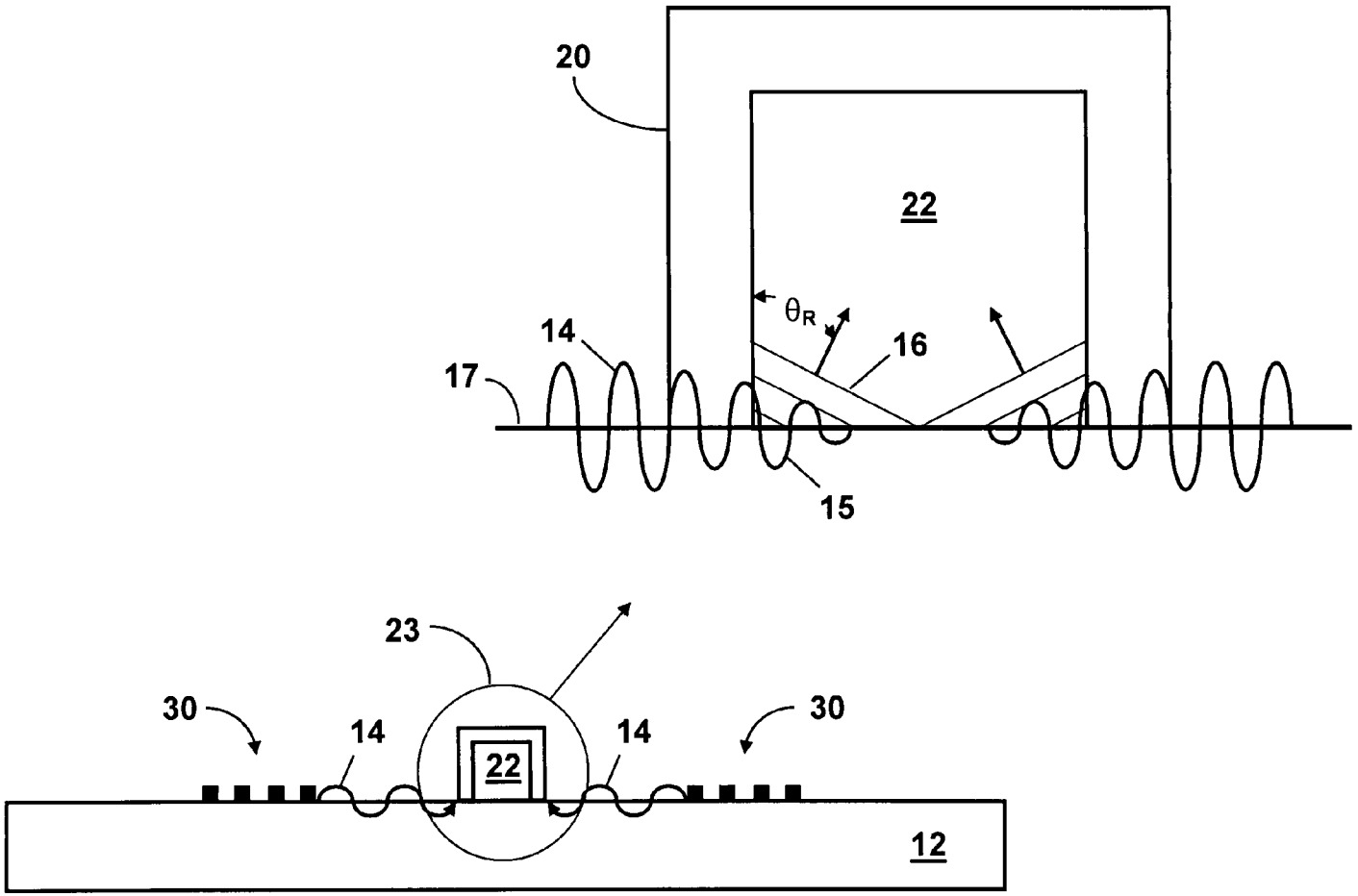
FIG. 3 shows a schematic side sectional view of the exemplary active micromixer, including an exploded view of the active mixing region.

In FIG. 3 is shown a schematic side sectional view of the exemplary active micromixer 10. A Rayleigh SAW 14 generated by an IDT 30 propagates along the free surface of the piezoelectric substrate 12 to the channel 20. A Rayleigh SAW mode has a displacement normal to the surface and comprises a retrograde elliptical motion along the wave propagation direction. When the propagating Rayleigh SAW reaches a solid/liquid boundary, this normal displacement can radiate into the fluid and the Rayleigh wave becomes leaky.

Also shown in FIG. 3 is an exploded side view of the active mixing region 23. The leaky Raleigh SAW 15 radiates a longitudinal wave 16 into the fluid 22 at the Rayleigh angle $\theta_R$, given by the acoustic law of refraction (i.e., $\theta_R$ is equal to the arc sin of the wave velocity in the liquid divided by the wave velocity in the solid). For a 128° YX $LiNbO_3$ Rayleigh wave converting to a longitudinal wave in water, the Rayleigh angle is about 23° to the surface normal. The leaky Rayleigh wave 15 decays along the propagation path where the piezoelectric surface 17 is in contact with the fluid 22. Therefore, the leaky Rayleigh SAW 15 converts to the longitudinal wave 16 within several acoustic wavelengths on the solid surface. Typically, the SAW frequency is chosen such that at least one wavelength exists within the width of the microfluidic channel 20. Additionally, the wavelength can be chosen to be larger than particles in the fluid, such as biological cells, to minimize disruption. For example, the acoustic velocity of a Rayleigh SAW in 128° YX $LiNbO_3$ is 3994 m/sec. Therefore, for a SAW frequency of 90 MHz, the acoustic wavelength is about 44 μm.

If the longitudinal wave 16 has a high enough intensity, acoustic streaming is induced in the fluid 22, resulting in efficient folding and stretching of the fluid 22 in the channel 20. The acoustic attenuation depends on the viscosity and density of the fluid at the SAW frequency. The acoustic streaming force scales as the frequency squared, attenuation cubed, displacement squared, and as the wavenumber in the fluid. Therefore, the acoustic streaming force is highly dependent on viscous losses in the fluid. In particular, SAW streaming can induce large gradients in the fluid because the effective radiation lost to the fluid is generated by the unique boundary conditions at the interface. Indeed, Shiokawa et al. have estimated that the streaming force can typically be $10^3$ stronger for SAW streaming compared to a bulk wave at the same operating frequency in water. Thus streaming flow, and therefore mixing, can be generated with a relatively small SAW power. Indeed, at higher power levels, fluidic samples can be vaporized, enabling gas phase detection of, for example, biological agents.

The microfluidic channel 20 can be fabricated on the top surface of the substrate. The microchannel structure 20 can comprise a rigid material, such as plastic, glass, or a silicon-based material, to minimize acoustic loss. The microchannel 20 can be bonded to the surface 17 of the substrate 12. Alternatively, a thin gasket of a soft acoustic material can be used to fluidically seal the microchannel 20 to the surface 17 and minimize acoustic attenuation at the interface. Alternatively, the microfluidic channel 20 can be recessed beneath a thin piezoelectric crystal surface layer or be otherwise acoustically coupled to the surface of the substrate 12. The width of the microchannel 20 can preferably be less than ten acoustic wavelengths and, more preferably, on the order of the SAW wavelength. The height of the microchannel 20 is preferably comparable to the acoustic attenuation length in the fluid and depends on the excited wavelength for optimal propagation distance. For example, the height can preferably be less than ten acoustic wavelengths in the fluid and, more preferably, less than a few acoustic wavelengths. Efficient mixing can be obtained by aligning the microfluidic channel 20 perpendicular to the SAW propagation direction. Alternatively, the microfluidic channel 20 can be aligned at various angles with the SAW propagation direction, including along or opposed to the direction of fluid flow.

Experimental Results Using SAW-Based Active Micromixers

Two SAW-based active micromixers where fabricated and their performances were evaluated. The first had bidirectional double split-finger IDTs, of the type shown in FIG. 1, and the second had bidirectional double split-finger IDTs with acoustic horns, of the type shown in FIG. 2. Each acoustic horn compressed the Rayleigh SAW by a factor of four to facilitate localized mixing within the microfluidic channels. Grating reflectors were used to minimize loss from the bidirectional IDTs. The IDTs were fabricated by a photolithographic process on the surface of a 128° YX $LiNbO_3$ piezoelectric substrate. The active mixing region was centered between the opposed IDTs. Microchannels were fabricated with dimensions required to produce Reynolds numbers less than two for highly laminar flow conditions. Fluorescence microscopy was used to actively monitor two separate flow streams as each passed through the active mixing region to assess mixing efficacy. Micro-particle velicometry (μPIV) was used to map the fluid velocity within this region. Fluid velocity was measured as a function of the power delivered to the micromixer to determine optimal operating conditions.

The SAW transducers were fabricated using single-side polished 128° YX $LiNbO_3$ (Crystal Technology, Inc., Palo Alto, Calif.) wafers as the piezoelectric substrate. A lift-off procedure was used to pattern the IDTs and reflectors. A 100 Å titanium (Ti) adhesive layer was first deposited on the $LiNbO_3$ wafers using an e-beam evaporator. A 900 Å gold layer was then deposited on the Ti film by resistive evaporation. Each IDT consisted of 56 finger pairs with an acoustic aperture of 38× and a metallization ratio of 0.5. The center-to-center separation of the opposed IDTs was 120. The IDTs supported Rayleigh waves with a center frequency of 90 MHz, having an insertion loss ranging from −7 to −10 dB. At this frequency, the acoustic wavelength was about 44 μm.

The acoustic horns were designed to provide a four-fold increase the acoustic power density at the operating frequency of 90 MHz. Each acoustic horn had an input aperture of about 500 μm and tapered, at less than the confinement angle, to a 125-μm-wide stripline that propagated the SAW beam to the active mixing region. Each acoustic horn and stripline were of the overlay waveguide type and comprised a 900 Å gold layer deposited an adhesion layer on top of the central waveguiding region of the $LiNbO_3$ substrate.

Figure 4:
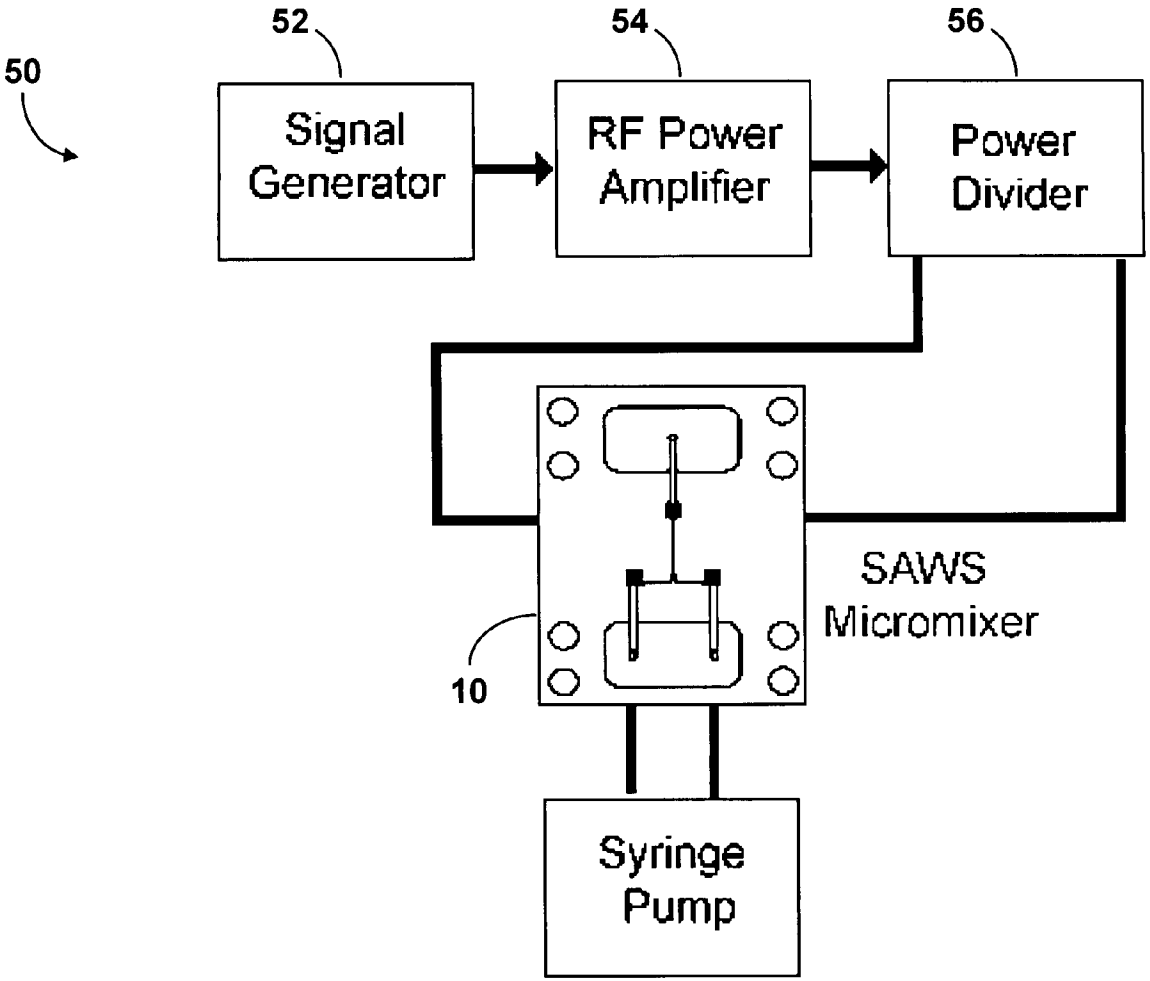
FIG. 4 shows an RF voltage source that can be used to simultaneously drive the opposing interdigital transducers of the active micromixer.

In FIG. 4 is shown a schematic illustration of an RF voltage source 50 that was used to simultaneously drive the SAW transducers 30 of the active micromixer 10. The RF voltage source comprised an RF signal generator 52 (HP 8656, Agilent Technologies, Palo Alto, Calif.). The signal was amplified with a 20W RF power amplifier 54 (ENI 420LA, Bell Electronics, Kent, Wash.) and split using a 50Ω power divider 56. The amplified signal provided power to both IDTs simultaneously during the mixing experiments. Output power was controlled by varying the input signal level of the RF signal generator 52 through software control. To account for transmission losses in the experimental setup, the overall system gain was measured using a vector voltmeter (HP 8508, Agilent Technologies, Palo Alto, Calif.). The actual acoustic power delivered to the SAW transducers was determined by measuring the return electrical loss of each transducer. Therefore, the electric to acoustic power transfer function, or insertion loss, could be determined.

Two different Y-junction microfluidic channels, comprising either PDMS or polycarbonate, were fabricated. The PDMS microchannel was used for rapid prototyping and to measure mixing efficacy using fluorescence microscopy. The polycarbonate microchannel was used for detailed particle velocity mapping using μPIV. Both channels provided low Reynolds numbers (Re<2) flows. To fabricate the microfluidic channels, silicon molds were selectively etched with a deep reactive ion etcher (DRIE, Unaxis SLR 770 ICP). Either PDMS or polycarbonate then could be cast onto the silicon mold to provide the microchannel.

Figure 5B:
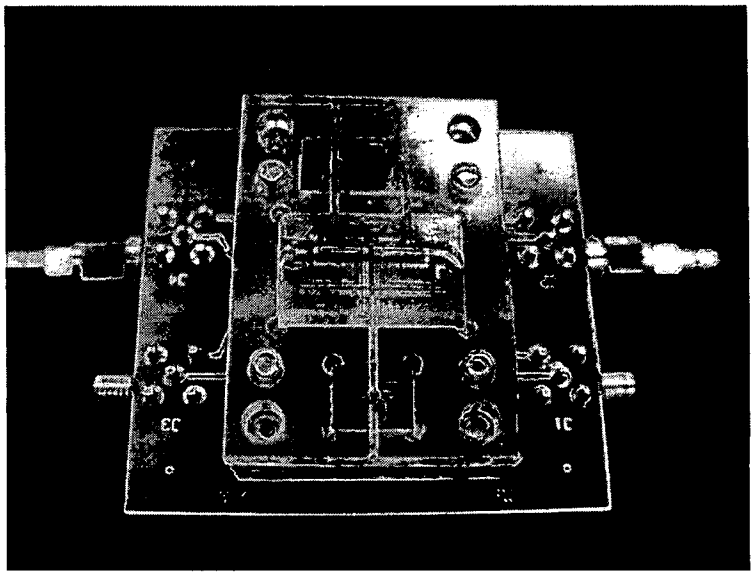
FIG. 5B shows a photograph of a polycarbonate microfluidic channel sealed to a 128° XY $LiNbO_3$ substrate having bidirectional double split-finger interdigital transducers.
Figure 5A:
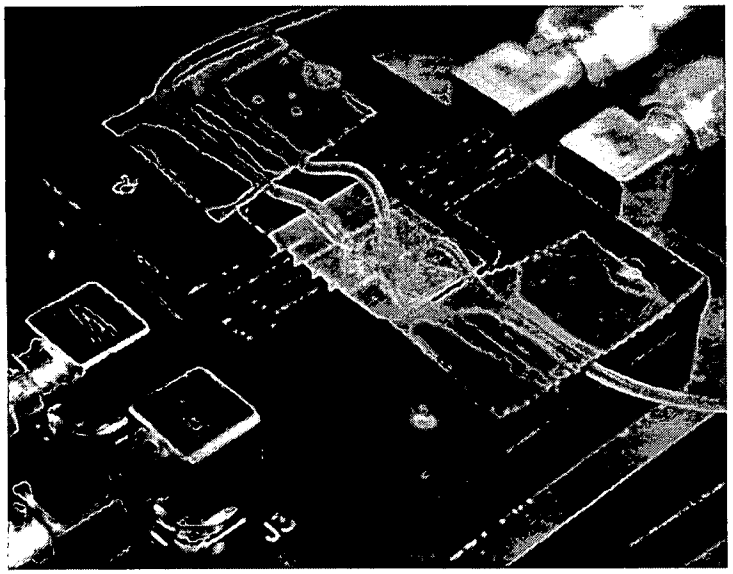
FIG. 5A shows a photograph of a polydimethylsiloxane (PDMS) microfluidic channel bonded to a 128° XY $LiNbO_3$ substrate having bidirectional double split-finger interdigital transducers to generate the contra-propagating SAWs.

In FIG. 5A is shown a photograph of a PDMS microchannel bonded to a 128° XY $LiNbO_3$ substrate. A silicon mold was etched with a width, height, and length of 50 μm, 110 μm, and 4 mm, respectively. PDMS was poured into the silicon mold to create the Y-junction microchannel. The PDMS microchannel was cast using a 1:10 (wt/wt) mixture of Sylgard silicone and silicone elastomer 184 (Dow Corning Corporation). Fluidic connections were cast directly into the PDMS using silicone rubber tubing and a fixture to hold the tubing in place. The PDMS microfluidic channel was attached to the $LiNbO_3$ substrate by heating the substrate to 90° C., followed by immediate contact. The PDMS microchannel was aligned with the IDTs to mate with the center of the active mixing region.

The mixing efficacy of two fluid streams was measured using an active micromixer of the type shown in FIG. 5A. The active micromixer comprised bidirectional double split-finger IDTs, of the type shown in FIG. 1, and a Y-junction microchannel fabricated in PDMS. The SAW transducer had an acoustic aperture of 1.7 mm. The volumetric flow rate was 10 μl $min^{-1}$, providing a Reynolds number of 2.0 in the PDMS microchannel. The average flow velocity was about 3.1 cm $sec^{-1}$. Therefore, the residence time in the active mixing region was about 0.13 sec.

The mixing efficacy was evaluated using the fluorescent dye Alexa-488. This dye is insensitive to pH between pH 4 and 10 and has superior quantum yield to fluorescein dyes. Since inks and dyes do not show any chemical reaction when mixed, proportional mixing can be observed within the microchannel. The micromixer was mounted in a fixture containing test probes (AlphaTest μHELIX®, AlphaTest Corporation, Mesa, Ariz.). The fixture was positioned on the stage of an optical microscope (Olympus IX-70, Olympus America, Melville, N.Y.). The emission (at 535 nm) was selected using an Alexa-488 filter (Chroma Scientific, Rockingham, Vt.). One input fluid stream contained a 100 mM PBS buffer pH 7.4 and the second had 250 μg $ml^{-1}$ protein-A (Sigma, St. Louis, Mo.) conjugated with Alexa-488 dye (Molecular Probes Inc., Eugene, Oreg.) dissolved in 100 mM PBS buffer pH 7.4. The two streams were introduced from syringes connected by PMMA tubing attached to the silicone rubber tubing connectors on the PDMS microchannels. A syringe pump (PHD 2000, Harvard Apparatus Inc., Holliston, Mass.) was used to control the volumetric flow rate.

The mixing efficacy was quantified by measuring the fluorescence intensity of the protein-A labeled with Alexa-488 across the cross-section of the active mixing region of the PDMS microchannel. Video images captured with a 12-bit CCD camera (Retiga 1300, Qlmaging, Burnaby, B.C. Canada) were converted into sequential 640×480 TIFF-formatted images. The fluorescent images were converted into a three-slice RGB stack, using the green slice to build a monotone spectrum. Color index ranged from 255 for black to 0 for green. The spatial-temporal variation of color in the PDMS microchannel was analyzed using an image-processing toolbox. The 12-bit images were processed by determining the color index for sets of pixels in the captured images. All microchannels were imaged at the midpoint (i.e., h/2=55 μm) depth of field.

Figures 6A, 6B, 6C:
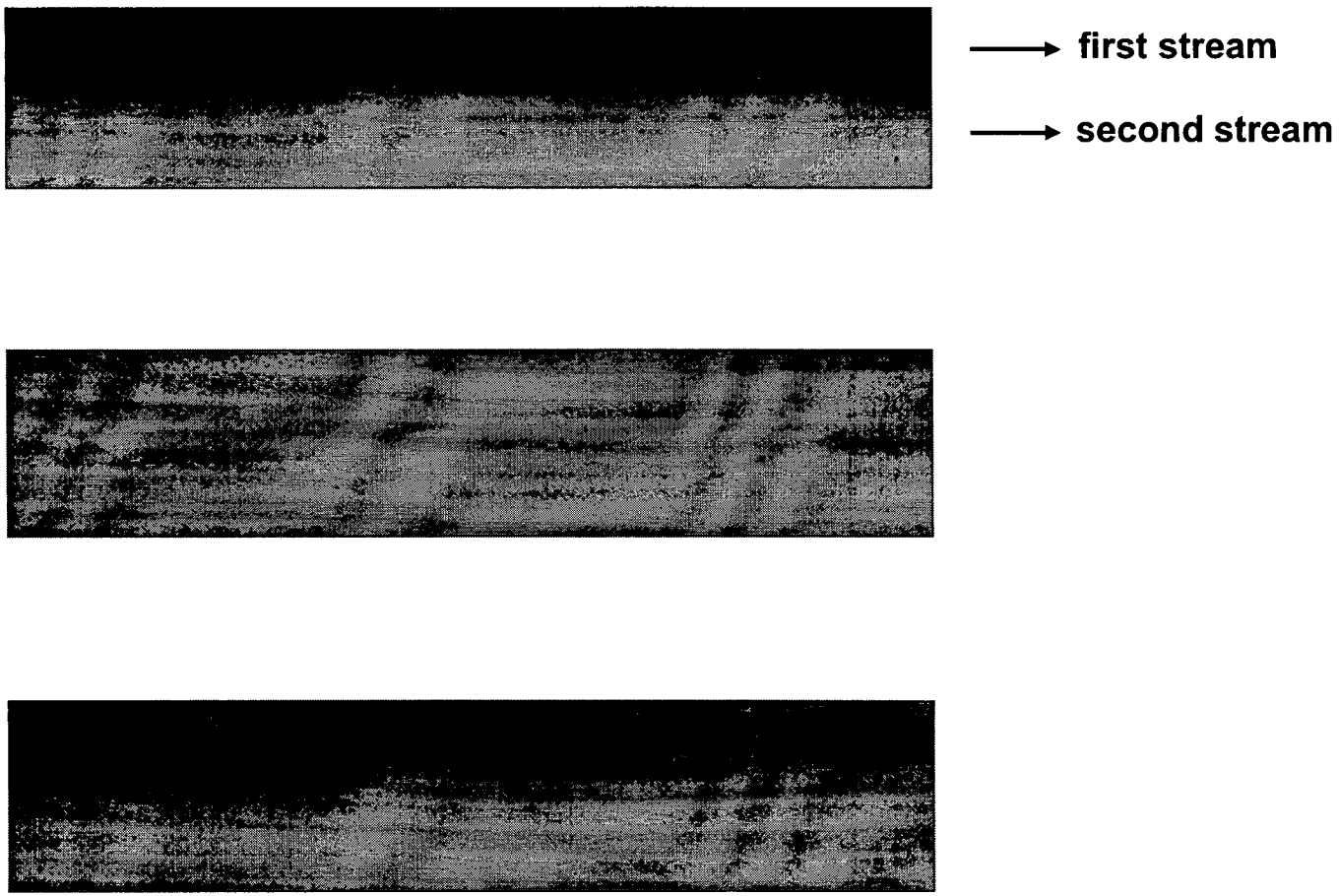
FIGS. 6A-6C show captured video frames with and without active mixing of the two fluid streams in the PDMS microchannel.

FIGS. 6A-6C show the captured video frames with and without active mixing of the two fluid streams in the PDMS microchannel. The captured segments were near the downstream edge of the active mixing region, about 2 mm from the Y-junction. The captured segments were 350 μm long and show the 50 μm width of the channel. Fluid flow was from left to right at a rate of 10 μl $min^{-1}$. Without active mixing, mixing of the streams by diffusion was calculated to take approximately 26 sec. Therefore, diffusion mixing would require about 800 mm of flow to homogenize the two flow streams.

FIG. 6A shows the established laminar flow condition (Re=2.0) in the PDMS microchannel in the absence of mixing. The light-shaded bottom half of image shows the fluorescence from the unmixed protein-A labeled Alexa-488 dye in the second fluid stream. The upper, dark-shaded portion of the image is due to the PBS buffered first stream. FIG. 6B shows the segment after a 100 mW, 90 MHz RF signal was applied to the active micromixer. The homogenous image indicates that the streams were mixed very rapidly after the acoustic excitation was applied. FIG. 6C shows that laminar flow was restored within 0.13 sec after the acoustic excitation was removed, as evidenced by the separated light- and dark-shaded streams.

The mixing index, α, was determined from the standard deviation of the color index, according to $$\alpha = \sqrt{\frac{1}{N}\sum_{i=1}^{N}\left[\frac{C_i - \overline{C}}{\overline{C}}\right]^2}$$

The color index was specified by $C_i$ at pixel i and $\overline{C}$ was the average over N pixels in the sampling region. Intensity variation in the images due to the CCD and lighting was corrected by normalizing the raw images before computing the mixing index (i.e., $\|C_i\|=1$). Though homogeneous mixtures would ideally have $\alpha \rightarrow 0$, the fluorescence variation of a uniform region often produced a noise floor above 0. This noise floor, $\alpha_n$, was estimated by measuring the background fluorescence variation of a uniform section of the fluorescence in the flow region. Based on this analysis, a well-mixed solution would approach $\alpha_n$ across the height of the microchannel.

To determine the mixing efficacy, the mixing index, α, was computed 1 mm downstream from the active mixing region in the microchannel. The fluorescence variation in a region of uniform fluid flow in FIG. 6A was used to estimate the noise floor, $\alpha_n$. Using the estimated noise floor, the normalized fluorescent background variation was calculated to be about 0.10. Therefore, complete mixing is indicated when a $\alpha \leqq 0.10$.

Figure 7:
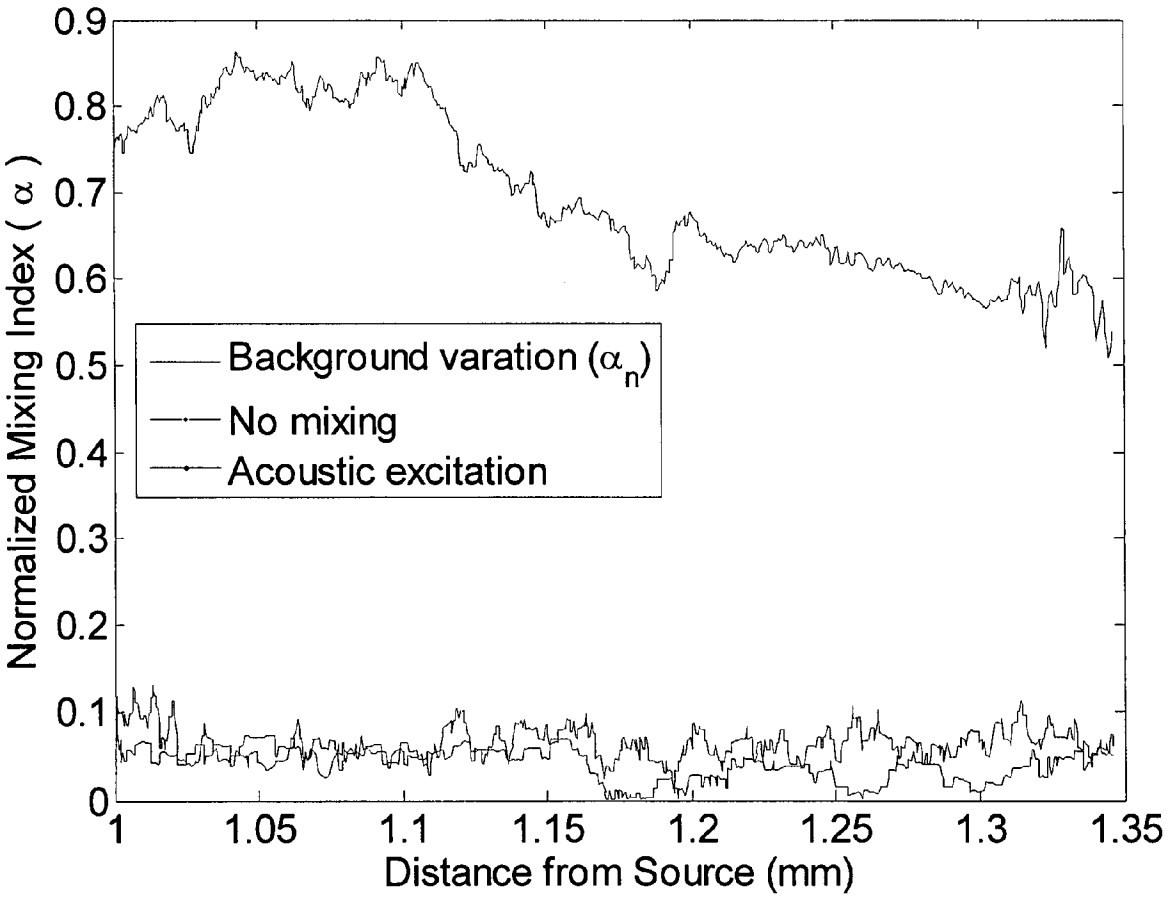
FIG. 7 shows plots of the mixing index sampled along the length of the PDMS microchannel in the presence and absence of acoustic excitation for laminar flow conditions.

In FIG. 7 are shown plots of the mixing index sampled along the length of the microchannel in the presence and absence of acoustic excitation for laminar flow conditions. In the absence of active mixing, the mixing index remained well above 0.50 throughout the entire cross-section of the microchannel. With acoustic excitation, the mixing index decreased to about 0.05 and was equal or below the noise floor throughout the entire microchannel. Therefore, a high degree of homogenization can be achieved in less than 1 second with the active micromixer of the present invention.

The mixing index was also determined using bidirectional double split-finger IDTs with acoustic horns, of the type shown in FIG. 2. Each acoustic horn had an aperture of 500 μm and compressed the SAW beam width to 125 μm, giving a four-fold increase in power density. When using the acoustic horns, only 20 mW of RF power was required to achieve similar mixing results as those without the horn. Although the active mixing region was only 125 μm in width with the horns, homogeneous mixing (i.e., $\alpha<0.1$) was observed throughout the PDMS microchannel. Further, the reduction of beam width had no appreciable effect on the overall homogeneity of mixing along the length of the microchannel.

The acoustic loss to a microchannel fabricated entirely from PDMS can result in significant attenuation of the incident Rayleigh SAW before it can couple to the fluid. Therefore, a polycarbonate microfluidic channel was fabricated to minimize the contact area of the PDMS gasket with the $LiNbO_3$ substrate. In FIG. 5B is shown a photograph of a polycarbonate microchannel sealed to a 128° XY $LiNbO_3$ substrate using a PDMS gasket. The polycarbonate microchannel also enabled improved optical access to the fluid in the active mixing region. The polycarbonate microchannel had a width, height, and length of 750 μm, 510 μm, and 7.6 mm, respectively. Micro-particle velicometry was used to characterize flow in the polycarbonate microchannel during active mixing using the bidirectional double split-finger IDTs without acoustic horns. μPIV is a velocity measurement technique that extracts instantaneous two-dimensional fluid velocity information from within microfluidic devices by tracking the motion of small, fluorescent tracer particles. The particle velocity data was used to estimate the local acoustic streaming force. The technique is capable of 1 micron-resolution in-plane and 2-3 micron resolution out-of-plane.

Figure 8:
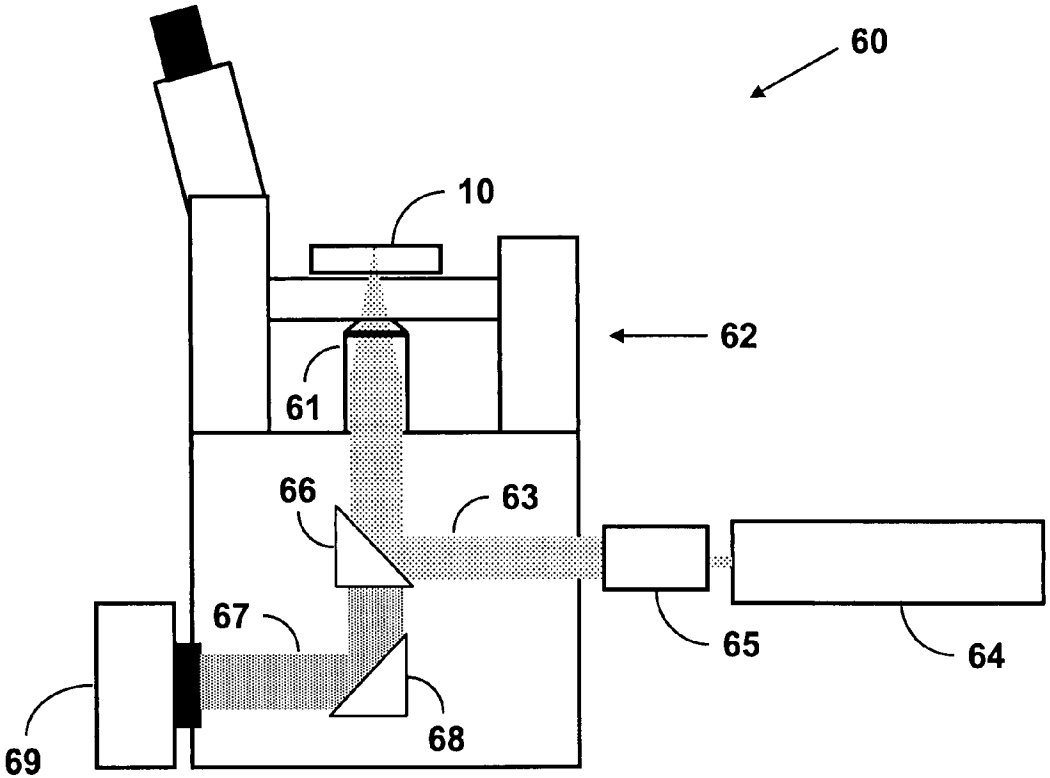
FIG. 8 shows a schematic illustration of a micro-particle velicometry image capturing system that was used to map the fluid velocity within the active mixing region.
Figure 9B:
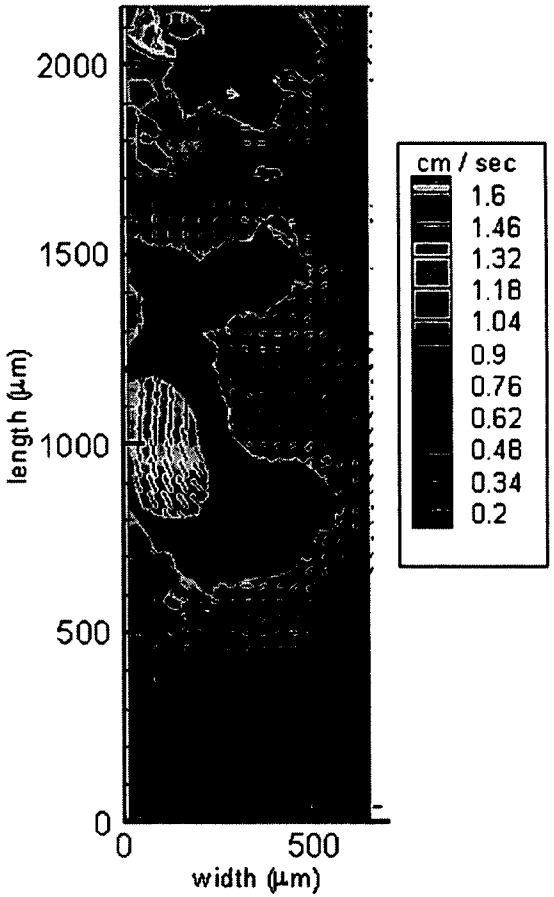
FIGS. 9A-9F show local velocity slices for two different heights and three different power levels in the polycarbonate microchannel. Slices were imaged in a plane parallel to the surface of the substrate.
Figure 9A:
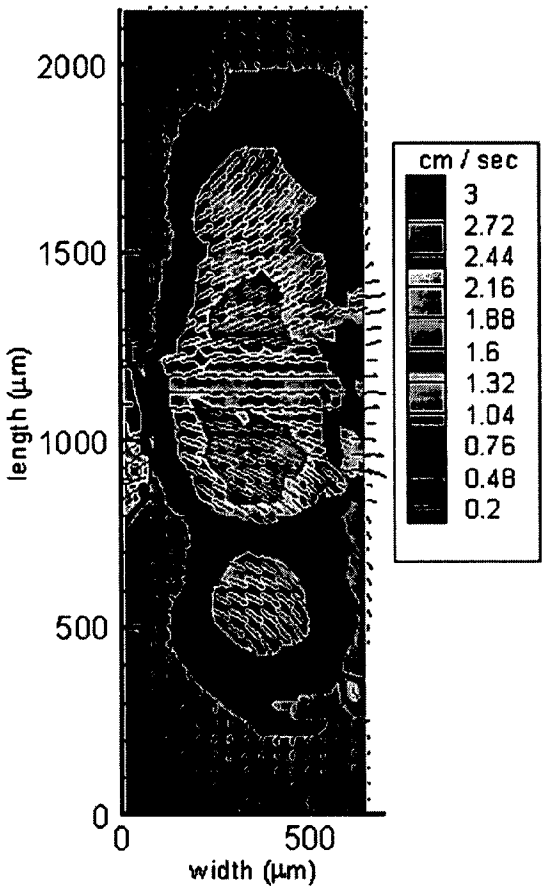
Figure 9D:
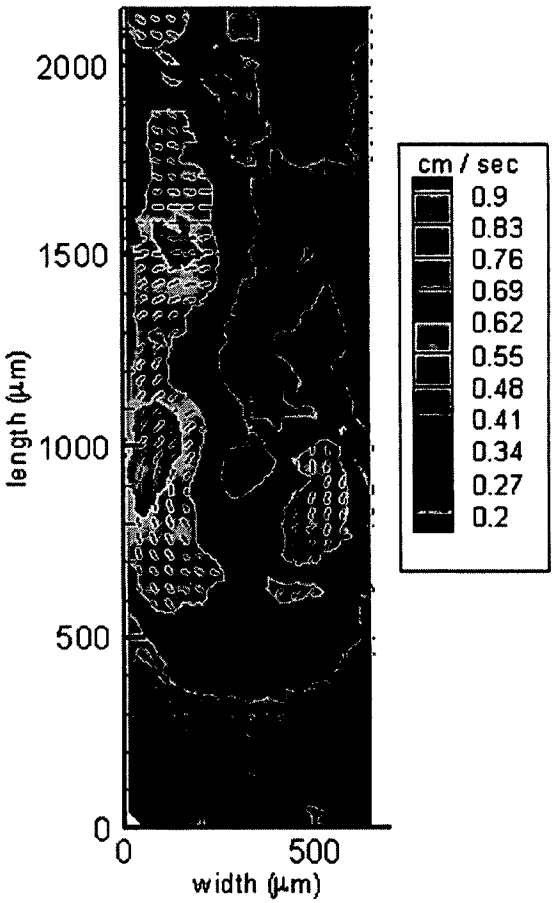
Figure 9C:
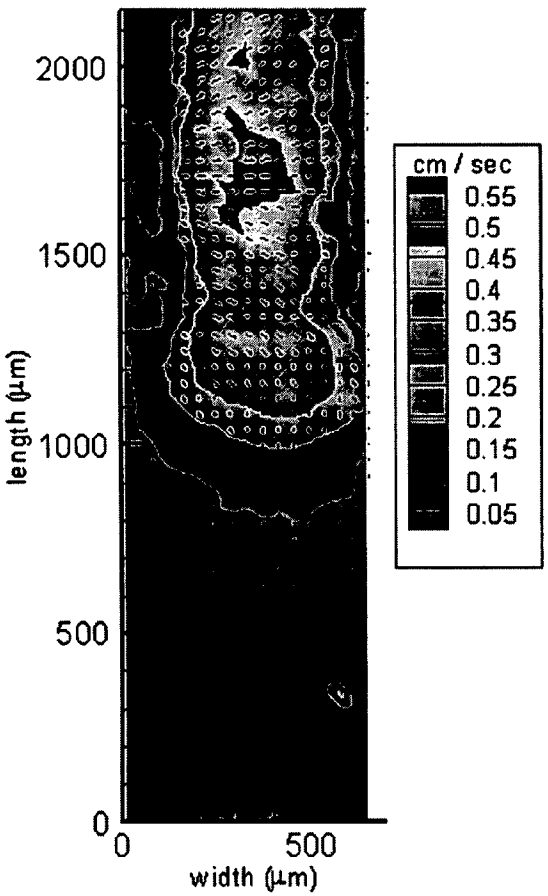
Figure 9F:
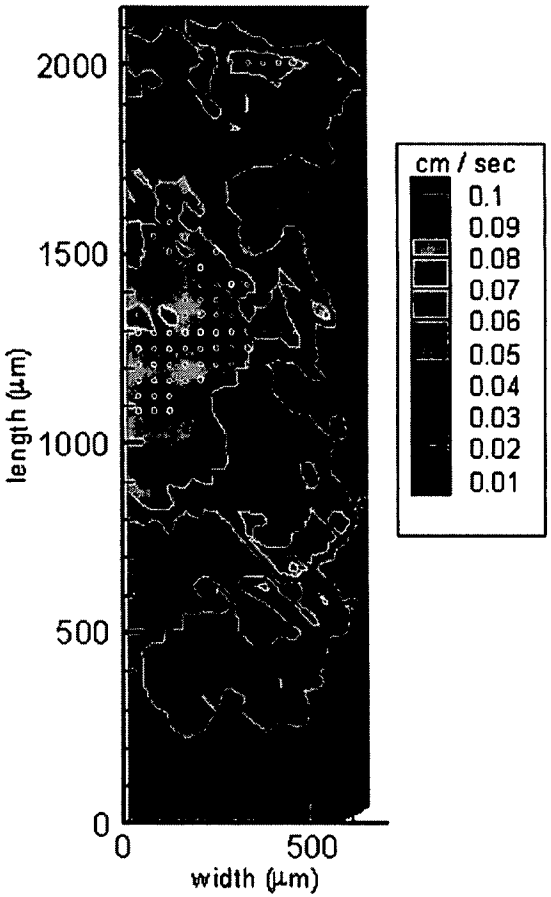
Figure 9E:
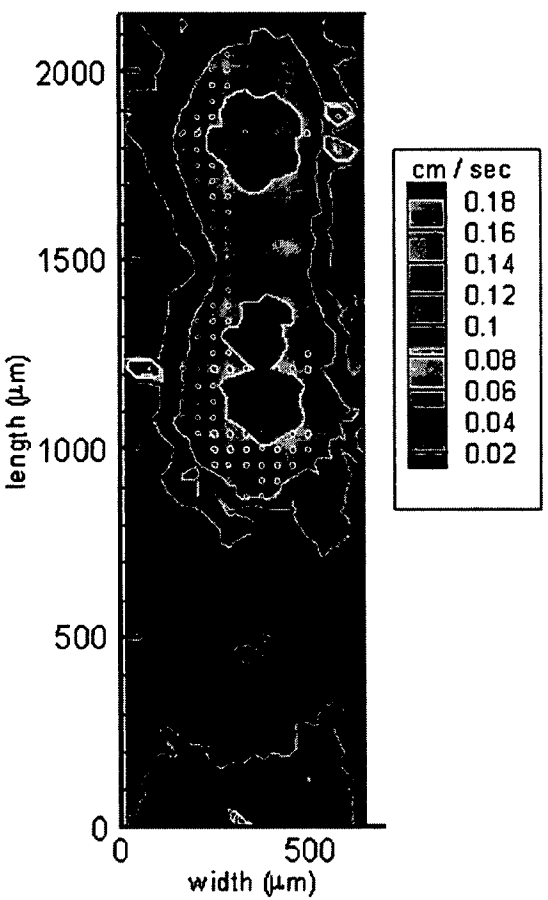

In FIG. 8 is shown a schematic illustration of the μPIV image capturing system 60. The active micromixer 10, of the type shown in FIG. 5B, was placed above the objective 61 of an epi-fluorescent microscope 62. Short wavelength (532 nm) excitation light 63 from an Nd:YAG laser 64 was expanded by a beam-expander 65, reflected off a dichroic epi-fluorescent filter cube 66, and entered the microscope 62 through an aperture. This illumination technique required that only one side of the active micromixer 10 to be optically accessible. The excitation light 63 was focused onto a portion of the active mixing region 23 by the imaging objective 61, illuminating the entire height of the fluid in the channel. Small micrometer-sized fluorescent microspheres were used as tracer particles in the μPIV experiments. These microspheres had a small particle size to avoid perturbing the flow and enabling rapid assessment of particle trajectory. The fluorescent microspheres ($d_p$=1 μm, Duke Scientific, Palo Alto, Calif.) had an excitation peak at 532 nm and an emission peak from 550-570 nm. The longer wavelength emitted light 67 from the particles, as well as scattered and reflected laser light, was filtered through the filter cube 66, reflected off a mirror 68, and imaged onto a CCD camera 69. The 12-bit 1300×1300 CCD camera was capable of capturing two frames within 200 ns. Images were processed using a single-pass cross-correlation technique having non-overlapping 32×32 pixel windows to obtain the velocity field and acoustic streaming force data.

The particle velocities due to active mixing alone were obtained at two-dimensional slices in the z-plane of the microchannel in the absence of external fluid flow. The active mixing region (i.e., the acoustic excitation region) was 1.7 mm in length and centered at 1 mm downstream from the Y-junction. In FIGS. 9A-9F are shown local velocity slices for two different heights and three different power levels in the microchannel. Slices were imaged in a plane parallel to the surface of the $LiNbO_3$ substrate. Zero length corresponds to the Y-junction, where the fluid streams join. The left-hand slices (FIGS. 9A, 9C, and 9E) were captured at 170 μm above the substrate surface. The right-hand slices (FIGS. 9B, 9D, and 9F) were captured at 340 μm above the substrate surface. The total excitation power (i.e., the combined power delivered to the SAWs from both IDTs) was 4.5 dBm (2.8 mW) for the slices in FIGS. 9A and 9B. The total excitation power was −3.5 dBm (0.47 mW) for the slices in FIGS. 9C and 9D. The total excitation power was −15.5 dBm (28 μW) for the slices in FIGS. 9E and 9F.

SAW streaming produces strong radiation forces acting on fluids and particles suspended in the fluids. Assuming Stokes drag (a reasonable assumption when Re<0.5), the equation of motion for a particle in an ultrasonic field was solved to estimate the acoustic streaming force. The solution of the velocity field can be written as $$v(t) = \frac{F_{ac}}{6\pi\eta r}\left(1 - e^{\frac{-6\pi\eta r}{m}t}\right)$$

where $F_{ac}$ is the net acoustic radiation force due on the particle, η is the fluid viscosity, and r is the particle radius, and m is the particle mass. For the case when equilibrium is reached at long times, the solution for the particle velocity becomes $$v(t) = \frac{F_{ac}}{6\pi\eta r}$$

Local particle velocities in excess of 3 cm $sec^{-1}$ were measured nearest the substrate surface for 4.5 dBm (3.2 mW) of total excitation power for the opposing IDTs. This particle velocity indicates an acoustic radiation force of 45 pN $m^{-2}$. The fluid velocity tended to decrease further from the piezoelectric substrate surface, aside from recirculation effects. The fluid velocities were highly non-uniform across the microchannel cross-section, as evidenced by the presence of fluidic sources and sinks. Slices imaged at 170 μm above the surface exhibited more uniform flow patterns, whereas the fluid motion at 340 μm above the surface was non-uniform. The largest velocity gradients were observed near the center of the excitation. These results indicate that the active micromixer is able to fold and stretch laminar streams to produce excellent mixing.

Figure 10:
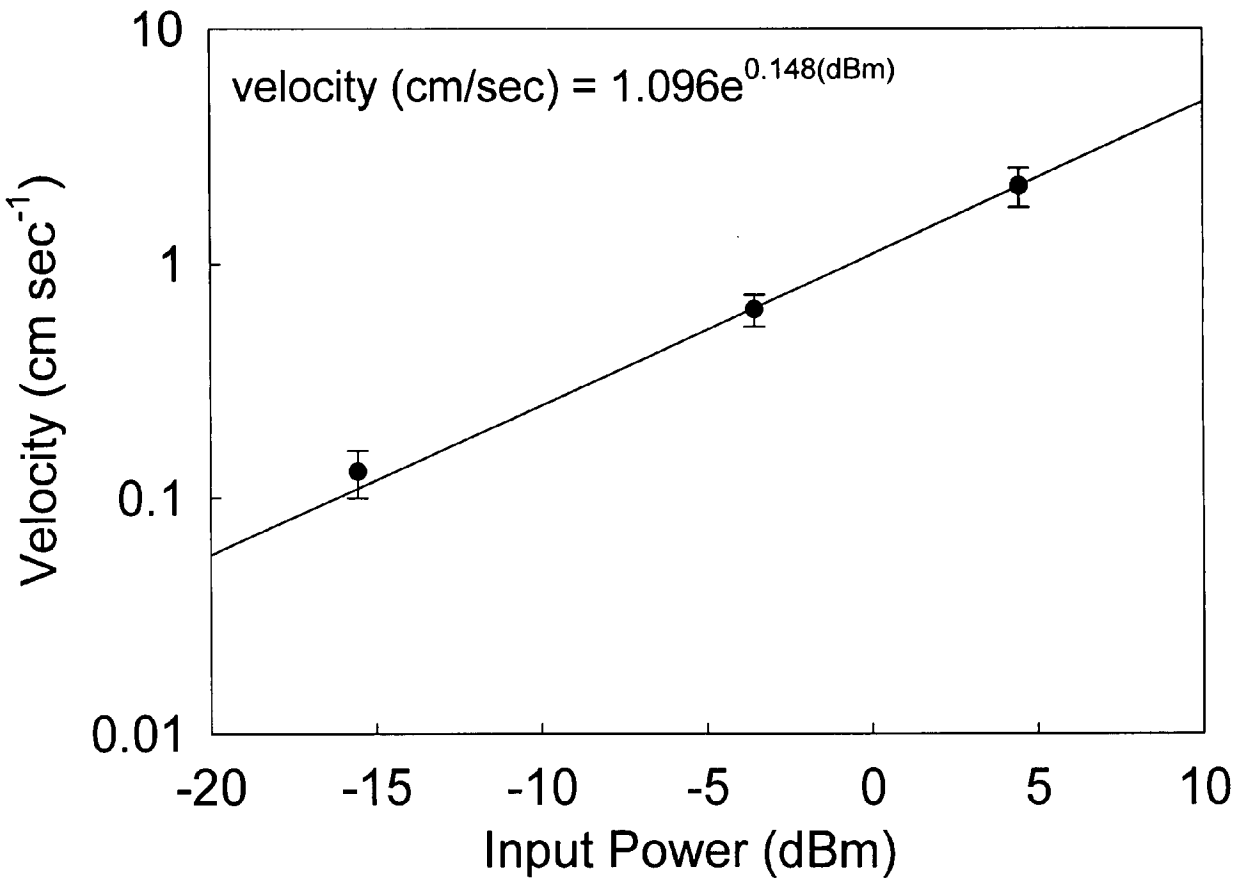
FIG. 10 shows a plot of the mean fluid velocity in the polycarbonate microfluidic channel as a function of the total input power.

By varying the total excitation power applied to the SAW transducers, the dependence of the mean fluid velocity on the input acoustic power, accounting for return losses, was determined. The mean fluid velocity was computed from μPIV data by sampling along the width of the active mixing region using the active micromixer without the acoustic horn (i.e., an acoustic aperture of 38λ). As shown in FIG. 10, even at very low power levels (28 μW), mean fluid velocities in excess of 0.1 cm $sec^{-1}$ were observed within the microchannel. A mean fluid velocity of 2 cm $sec^{-1}$ was measured for 4.5 dBm of input power. No acoustic cavitation was observed in the fluid at this power. This dependence permits selection of appropriate power requirements to achieve a desired fluid velocities and mixing strength. For the acoustic horn (i.e., an acoustic aperture of 9.5λ), the same mean fluid velocities could be obtained with a four-fold decrease in power. Therefore, geometrical modifications can dramatically reduce power requirements, while maintaining mixing efficacy.

The present invention has been described as an active micromixer using SAW streaming. It will be understood that the above description is merely illustrative of the applications of the principles of the present invention, the scope of which is to be determined by the claims viewed in light of the specification. Other variants and modifications of the invention will be apparent to those of skill in the art.

We claim:

1. An active micromixer, comprising:

a piezoelectric substrate having a surface;

a microfluidic channel fluidically sealed on the surface of the substrate, containing a fluid that is acoustically coupled to the surface of the substrate;

a single pair of opposing interdigital transducers on the surface of the substrate, wherein the interdigital transducers are paired opposite to one another and separated by the microfluidic channel; and an RF signal generator for exciting the opposing interdigital transducers and generating opposing surface acoustic waves that propagate on the surface of the substrate to the microfluidic channel and couple energy into the fluid normal to the surface in an active mixing region of the microfluidic channel defined by the acoustic aperture of the opposing interdigital transducers.

2. The active micromixer of claim 1, wherein the surface acoustic wave comprises a Rayleigh wave.

3. The active micromixer of claim 1, wherein the piezoelectric substrate comprises an oriented crystal plate.

4. The active micromixer of claim 3, wherein the piezoelectric substrate comprises crystalline quartz, zinc oxide, aluminum nitride, lithium niobate, or lithium tantalite.

5. The active micromixer of claim 4, wherein the crystal plate comprises 128° YX $LiNbO_3$.

6. The active micromixer of claim 1, wherein the piezoelectric substrate comprises a piezoelectric crystal layer on a rigid substrate.

7. The active micromixer of claim 1, wherein the surface of the piezoelectric substrate comprises a piezoelectric portion for the generation of the surface acoustic waves and an elastic portion for the propagation of the surface acoustic waves.

8. The active micromixer of claim 1, wherein the at least one of the opposing interdigital transducers comprises a focusing interdigital transducer.

9. The active micromixer of claim 1, further comprising at least one acoustic waveguide to confine the lateral extent of at least one of the surface acoustic waves on the surface of the substrate.

10. The active micromixer of claim 9, wherein the at least one acoustic waveguide comprises an acoustic horn to concentrate the acoustic field at the active mixing region.

11. The active micromixer of claim 1, further comprising an acoustic reflector on the side of at least one of the opposing interdigital transducers opposite the microfluidic channel.

12. The active micromixer of claim 1, further comprising an acoustic absorber on the side of the at least one of the opposing interdigital transducers opposite the microfluidic channel.

13. The active micromixer of claim 1, wherein the fluid flows substantially in the length direction of the microfluidic channel and wherein the propagation direction of the surface acoustic waves is substantially perpendicular to the flow direction of the fluid in the microfluidic channel.

14. The active micromixer of claim 1, wherein the microfluidic channel comprises a rigid material.

15. The active micromixer of claim 14, wherein the rigid material comprises glass, plastic, or a silicon-based material.

16. The active micromixer of claim 1, wherein the microfluidic channel has a width of less than ten acoustic wavelengths.

17. The active micromixer of claim 1, wherein the microfluidic channel has a height of less than ten acoustic wavelengths.

18. The active micromixer of claim 1, further comprising a junction region upstream of the active mixing region for joining two or more input fluid streams into the microfluidic channel.

* * * * *